US005906662A

United States Patent [19]

McCombes

[11] Patent Number: 5,906,662

[45] Date of Patent: May 25, 1999

[54] LIQUID HYDROCARBON FUEL COMPOSITION

[75] Inventor: Paul Thomas McCombes, Chester, United Kingdom

[73] Assignee: Shell Oil Company, Houston, Tex.

[21] Appl. No.: 08/892,121

[22] Filed: Jul. 15, 1997

[30] Foreign Application Priority Data

Jul. 16, 1996 [EP] European Pat. Off. ..... 96305214

[51] Int. Cl.[6] ..... C10L 1/04

[52] U.S. Cl. ..... 44/300; 585/14

[58] Field of Search ..... 585/14; 44/300

[56] References Cited

U.S. PATENT DOCUMENTS

| | | | |
|---|---|---|---|
| 3,068,272 | 12/1962 | Holmquist . | |
| 5,234,475 | 8/1993 | Malhotra et al. | 44/282 |
| 5,474,937 | 12/1995 | Anderson, II et al. | 436/27 |
| 5,512,066 | 4/1996 | Toman et al. | 44/300 |

FOREIGN PATENT DOCUMENTS

| | | | |
|---|---|---|---|
| 93339584 | 6/1992 | Japan | C10L 1/18 |
| 5-339584 | 12/1993 | Japan . | |

OTHER PUBLICATIONS

Int S/Report—Dec. 15, 1997.

*Primary Examiner*—Sharon Gibson
*Assistant Examiner*—Cephia D. Toomer

[57] ABSTRACT

The present invention provides a liquid hydrocarbon fuel composition comprising a major amount of a liquid hydrocarbon fuel and, as identifiable marker, a detectable amount of at least one $C_{7-20}$ hydrocarbon containing at least one non-aromatic carbocyclic ring of at least 7 ring carbon atoms; and a method of modifying a liquid hydrocarbon fuel which comprises adding to the fuel, as identifiable marker, a detectable amount of at least one $C_{7-20}$ hydrocarbon containing at least one non-aromatic carbocyclic ring of at least 7 ring carbon atoms.

16 Claims, No Drawings

LIQUID HYDROCARBON FUEL COMPOSITION

FIELD OF THE INVENTION

The present invention relates to liquid hydrocarbon fuel compositions and to methods of modifying liquid hydrocarbon fuels.

BACKGROUND OF THE INVENTION

There is a need to be able to identify various hydrocarbon fuels, such as gasolines, kerosines, jet fuels, diesel fuels heating oils and heavy fuel oils, from the points of view both of type and origin. Identification of the origin of spillages, and detection of counterfeiting or fraud are examples of such need.

U.S. Pat. No. 5,234,475 (ass. SRI International) indicates that prior art attempts to use dyes, detection of which would be by fluorescence, have suffered from the problem that gasoline and other fuel fluorescence strongly in the absence of added dye. Furthermore, in the case of spills, dyes tend to adsorb onto soil and become eliminated from spilled fuel.

In order to seek to overcome such problems, U.S. Pat. No. 5,234,475 provides for incorporation into hydrocarbon fuels of quantities of one or more fullerene derivatives. Such materials are described as clustered carbon structures generally spherical in shape and having a carbon content generally ranging from about 50 to about 90 carbon atoms, those having the structures $C_{60}$ (buckminsterfullerene), $C_{70}$, $C_{74}$, $C_{76}$, $C_{78}$, $C_{82}$, $C_{84}$, $C_{86}$, $C_{88}$, $C_{90}$, $C_{92}$ and $C_{94}$ being specifically mentioned (Col. 2, lines 25 to 30). Identification may be by mass spectroscopy, UV-visible spectroscopy or high pressure liquid chromatography (HPLC) (Col. 2, lines 50 to 60).

U.S. Pat. No. 5,474,937 (ass. Isotag) describes a method for identifying the source of a transported chemical shipment, such as crude oil. This method employs a chemical element or an organic compound with one or more atoms which are non-radioactive isotopes generally not found in nature. Identification of samples as marked material is by comparison with an authentic sample of marked material. Preferred compounds are deuterated compounds or those rendered isotopic by carbon-13, fluorine- 19, nitrogen- 15, oxygen- 17 and oxygen- 18. Gas chromatography and mass spectroscopy are mentioned as appropriate analysis techniques. The examples relate to crude oil. Example 1 uses deuterated octane. Example 2 uses deuterated acetone. Example 3 does not use any specified isotopes, but employs a mixture of tetrafluoroethylene, chloroform and trichloroethylene in "the ratio" 1:3:7.

Each of these prior art approaches has the disadvantage either that it employs unusual or not readily obtainable additive or additives or that it employs one or more additives which are chemically different from anything else which might be present in the liquid to be identified, and which therefore may have the potential to interact adversely with one or more performance additives which might be incorporated when the liquid to be identified is a hydrocarbon fuel.

SUMMARY OF THE INVENTION

According to the present invention there is provided a liquid hydrocarbon fuel composition comprising a major amount of a liquid hydrocarbon fuel and, as identifiable marker, a detectable amount of at least one $C_{7-20}$ hydrocarbon containing at least one non-aromatic carbocyclic ring of at least 7 ring carbon atoms.

DETAILED DESCRIPTION OF THE INVENTION

Liquid hydrocarbon fuels include gasolines, kerosines, jet fuels, diesel fuels, heating oils and heavy fuel oils. Such fuels may consist substantially of hydrocarbons or they may contain blending components, such as alcohols or ethers. The fuels may variously include one or more additives such as flow improvers, anti-static agents, anti-oxidants, wax anti-settling agents, corrosion inhibitors, ashless detergents, anti-knock agents, ignition improvers, dehazers, re-odorants, pipeline drag reducers, lubricity agents, cetane improvers, spark-aiders, valve-seat protection compounds, synthetic or mineral oil carrier fluids and anti-foaming agents.

Liquid hydrocarbon fuels of the gasoline boiling range are typically mixtures of hydrocarbons boiling in the temperature range from about 25° C. to about 232° C., comprising mixtures of saturated hydrocarbons, olefinic hydrocarbons and aromatic hydrocarbons. Preferred are gasolines having a saturated hydrocarbon content ranging from about 40% to about 80% by volume, an olefinic hydrocarbon content from 0% to about 30% by volume and an aromatic hydrocarbon content from about 10% to about 60% by volume. The base fuel is derived from straight run gasoline, polymer gasoline, natural gasoline, dimer and trimerized olefins, synthetically produced aromatic hydrocarbon mixtures, from thermally or catalytically reformed hydrocarbons, or from catalytically cracked or thermally cracked petroleum stocks, and mixtures of these. The hydrocarbon composition and octane level of the base fuel are not critical. The octane level, (R+M)/2, will generally be above about 85 (where R is Research Octane Number and M is Motor Octane Number). Liquid hydrocarbon fuels which are middle distillate fuel oils typically have a boiling range in the range 100° C. to 500° C., e.g. 150° C. to 400° C. Petroleum-derived fuel oils may comprise atmospheric distillate or vacuum distillate, or cracked gas oil or a blend in any proportion of straight run and thermally and/or catalytically cracked distillates. Fuel oils include kerosine, jet fuels, diesel fuels, heating oils and heavy fuel oils. Preferably the fuel oil is a diesel fuel. Diesel fuels typically have initial distillation temperature about 160° C. and final distillation temperature of 290–360° C., depending on fuel grade and use. Preferred diesel fuels are low-sulphur diesel fuels.

The natures of crude oil and the process steps leading to the production of fuel components therefrom are such that liquid hydrocarbon fuels do not naturally contain any compound whose molecular structure incorporates a carbocyclic ring of greater than 6 carbon atoms. (N.B. A "carbocyclic ring" represents a single ring, so that the bicyclic compound decahydronaphthalene is an example of a compound whose molecular structure contains a carbocyclic ring of 6 carbon atoms.) The present invention further provides a method of modifying a liquid hydrocarbon fuel which comprises adding to the fuel, as identifiable marker, a detectable amount of at least one $C_{7-20}$ hydrocarbon containing at least one non-aromatic carbocyclic ring of at least 7 ring carbon atoms.

The carbocyclic ring may bear one or more alkyl or alkenyl groups, but it preferred that the or each said $C_{7-20}$ hydrocarbon contains a non-aromatic carbocyclic ring of 7 to 12 carbon atoms optionally substituted by 1 to 3 methyl groups.

The said $C_{7-20}$ hydrocarbons are either known compounds or can be synthesised by known methods, e.g. as described in Theilheimer's Synthetic Methods of Organic Chemistry, ed. W. Theilheimer, ISBN 0-318-55594-8, Bowker.

Thus, for example, cyclododecatriene may be prepared by trimerisation of butadiene, and the cyclododecatriene may be hydrogenated to yield cyclododecane, as described by Morikawa, et al Hydrocarbon Process. (1972), 51(8), 102–4.

Cycloheptane, 1,3-cycloheptadiene, cycloheptatriene, cyclooctane, cyclooctene, 1,3-cyclooctadiene, 1,5-cyclooctadiene, 1,5-dimethyl-1,5-cyclooctadiene, cyclodecane, cyclododecene and cyclododecatriene are all commercially available ex Aldrich.

Preferably, the marker comprises from 1 to 4 of the said $C_{7-20}$ hydrocarbons, more preferably 1 to 4 non-aromatic hydrocarbons selected from cycloheptane, 1,3-cycloheptadiene, cycloheptatriene, cyclooctane, cyclooctene, 1,3-cyclooctadiene, 1,5-cyclooctadiene, 1,5-dimethylcyclooctadiene, cyclodecane, cyclododecane, cyclododecene, and cyclododecatriene.

If more than one of the hydrocarbons is present, identification can be based on the combination of such hydrocarbons and their relative amounts, and not just on the concentration of a single compound.

For example, if from a base selection of seven different $C_{7-20}$ hydrocarbons three were selected for each application, and if each hydrocarbon were to be incorporated at one of four different concentration levels, a total of 2240 different combinations would be available (35 ways of selecting 3 from 7, multiplied by 64 different concentration combinations).

For convenience and ease of detection, preferably the or each of said $C_{7-20}$ hydrocarbons is present in an amount in the range 10 to 1000 ppmw based on the liquid hydrocarbon fuel.

Most preferably, the liquid hydrocarbon fuel is a gasoline or diesel fuel, so that the liquid hydrocarbon fuel composition is a gasoline or diesel fuel composition.

The said $C_{7-20}$ hydrocarbons described above are chemically similar to and have similar total numbers of carbon atoms in their molecules to components which are naturally present in the liquid hydrocarbon fuel. The result is that the presence of one or more of these $C_{7-20}$ hydrocarbons will not make any significant difference to the properties of the fuel composition. For the same reason, an unsuspecting counterfeiter would be unlikely to appreciate the presence of the said $C_{7-20}$ hydrocarbon(s) in authentic fuel compositions.

Detection of the non-aromatic hydrocarbon(s) in a liquid hydrocarbon fuel composition may be by one or more of a number of known techniques, e.g. by gas chromatography combined with mass spectrometry (GC-MS) or by gas chromatography combined with flame-ionisation detection (GC-FID). GC-FID is particularly suited to the case where the non-aromatic hydrocarbon(s) is(are) unsaturated, especially for concentrations of individual hydrocarbons down to as low as 1 ppmw based on the liquid hydrocarbon fuel.

The invention will be further understood from the following example which is included for illustrative purposes only and is in no way meant to limit the present invention.

EXAMPLE

Cyclododecane was incorporated in a base gasoline at concentrations of 1 mg/ml (about 1000 ppmw), 100 microgram/ml (about 100 ppmw) and 10 microgram/ml (about 10 ppmw).

Gas chromatography combined with mass spectrometry using a "VG TRIO-1" apparatus ex VG Masslab. A Hewlett Packard 50 mx 0.5×0.21 "PONA" (cross-linked methyl silicone) gas chromatography column was used, with helium at 15 pounds per square inch ($10.3\times10^4$ Pa) as carrier, injector volume 0.5 to 1 microliter, injector at 300° C.

By viewing the M/Z 168 (M+) peak, the presence of cyclododecane in the gasoline was observable at each of the three concentrations.

What is claimed is:

1. A liquid hydrocarbon fuel composition comprising a major amount of a liquid hydrocarbon fuel and, as identifiable marker, a detectable amount of at least $C_{7-20}$ hydrocarbon containing at least one non-aromatic carbocyclic ring of at least one 7 ring carbon atoms wherein the or each non-aromatic hydrocarbon is present in an amount in the range of 10 to 1000 ppmw based on the liquid hydrocarbon fuel.

2. The composition of claim 1 wherein the or each said $C_{7-20}$ hydrocarbon contains a non-aromatic carbocyclic ring of 7 to 12 ring carbon atoms optionally substituted by 1 to 3 methyl groups.

3. The composition of claim 2 wherein the marker comprises from one to four non-aromatic hydrocarbons selected from cycloheptane, 1,3-cycloheptadiene, cycloheptatriene, cyclooctane, cyclooctene, 1,3-cyclooctadiene, 1,5-cyclooctadiene, 1,5-dimethyl-1,5-cyclooctadiene, cyclodecane, cyclododecane, cyclododecene and cyclododecatriene.

4. The composition of claim 1 which is a gasoline or diesel fuel composition.

5. A method of modifying a liquid hydrocarbon fuel which comprises adding to the fuel, as identifiable marker, a detectable amount of at least one $C_{7-20}$ hydrocarbon containing at least one non-aromatic carbocyclic ring of at least one 7 ring carbon atoms wherein the or each non-aromatic hydrocarbon is present in an amount in the range of 10 to 1000. ppmw based on the liquid hydrocarbon fuel.

6. The method of claim 5 wherein the or each said $C_{7-20}$ hydrocarbon contains a non-aromatic carbocyclic ring of 7 to 12 ring carbon atoms optionally substituted by 1 to 3 methyl groups.

7. The method of claim 5 wherein the marker comprises from one to four non-aromatic hydrocarbons selected from cycloheptane, 1,3-cycloheptadiene, cycloheptatriene, cyclooctane, cyclooctene, 1,3-cyclooctadiene, 1,5-cyclooctadiene, 1,5-dimethyl-cyclooctadiene, cyclodecane, cyclododecane, cyclododecene, and cyclododecantriene.

8. The method of claim 6 wherein the marker comprises from one to four non-aromatic hydrocarbons selected from cycloheptane, 1,3-cycloheptadiene, cycloheptatriene, cyclooctane, cyclooctene, 1,3-cyclooctadiene, 1,5-cyclooctadiene, 1,5-dimethyl-cyclooctadiene, cyclodecane, cyclododecane, cyclododecene, and cyclododecantriene.

9. The method of claim 5 wherein the liquid hydrocarbon fuel is a gasoline or diesel fuel.

10. The composition of claim 1 wherein the marker comprises from one to four non-aromatic hydrocarbons selected from cycloheptane, 1,3-cycloheptadiene, cycloheptatriene, cyclooctane, cyclooctene, 1,3-cyclooctadiene, 1,5-cyclooctadiene, 1,5-dimethyl-1,5-cyclooctadiene, cyclodecane, cyclododecane, cyclododecene and cyclododecatriene.

11. The composition of claim 2 which is a gasoline or diesel fuel composition.

12. The composition of claim 3 which is a gasoline or diesel fuel composition.

13. The composition of claim 10 which is a gasoline or diesel fuel composition.

14. The method of claim 6 wherein the liquid hydrocarbon fuel is a gasoline or diesel fuel.

15. The method of claim 7 wherein the liquid hydrocarbon fuel is a gasoline or diesel fuel.

16. The method of claim 8 wherein the liquid hydrocarbon fuel is a gasoline or diesel fuel.

* * * * *